US011306603B2

(12) United States Patent
Iwasaki et al.

(10) Patent No.: US 11,306,603 B2
(45) Date of Patent: Apr. 19, 2022

(54) STEAM TURBINE

(71) Applicant: MITSUBISHI HEAVY INDUSTRIES, LTD., Tokyo (JP)

(72) Inventors: Makoto Iwasaki, Tokyo (JP); Rimpei Kawashita, Tokyo (JP); Katsuya Yamashita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/097,187

(22) Filed: Nov. 13, 2020

(65) Prior Publication Data

US 2021/0148249 A1 May 20, 2021

(30) Foreign Application Priority Data

Nov. 19, 2019 (JP) ..... JP2019-208744

(51) Int. Cl.

| | |
|---|---|
| ***F01D 11/02*** | (2006.01) |
| ***F01D 5/12*** | (2006.01) |
| ***F01D 11/00*** | (2006.01) |
| ***F01D 25/24*** | (2006.01) |

(52) U.S. Cl.

CPC ..... *F01D 11/02* (2013.01); *F01D 5/12* (2013.01); *F01D 11/005* (2013.01); *F01D 25/24* (2013.01); *F05D 2220/31* (2013.01); *F05D 2240/55* (2013.01); *F05D 2240/60* (2013.01)

(58) Field of Classification Search

CPC ..... F05D 2240/126; F05D 2260/14; F05D 2240/55; F01D 11/006; F01D 11/02; F01D 11/08

See application file for complete search history.

(56) References Cited

U.S. PATENT DOCUMENTS

| | | | | |
|---|---|---|---|---|
| 4,420,161 | A * | 12/1983 | Miller | F01D 25/04 277/418 |
| 7,600,965 | B2 * | 10/2009 | Seitz | F01D 11/08 415/144 |
| 9,879,786 | B2 * | 1/2018 | Kuwamura | F15D 1/10 |
| 10,247,025 | B2 * | 4/2019 | Matsumoto | F01D 11/08 |

(Continued)

FOREIGN PATENT DOCUMENTS

| | | |
|---|---|---|
| JP | 2007-120476 | 5/2007 |
| JP | 2011-141015 | 7/2011 |

(Continued)

*Primary Examiner* — Eldon T Brockman

(74) *Attorney, Agent, or Firm* — Wenderoth, Lind & Ponack, L.L.P.

(57) ABSTRACT

A steam turbine includes a rotary shaft configured to rotate about an axis, a rotor blade including a rotor blade body extending radially outward from the rotary shaft, and a shroud on an end outside in a radial direction, a casing enclosing the rotor blade from outside in the radial direction and including a cavity accommodating the shroud on an inner circumference of the casing, a plurality of seal fins protruding radially inward from an opposing surface that faces the shroud in the cavity such that a clearance is between an outer circumferential surface of the shroud and the plurality of seal fins, and a plurality of swirl breaks upstream of the plurality of seal fins located furthest upstream in a direction of the axis in the cavity, the plurality of swirl breaks being arranged at intervals in a circumferential direction.

2 Claims, 10 Drawing Sheets

(56) References Cited

U.S. PATENT DOCUMENTS

| | | | | |
|---|---|---|---|---|
| 11,136,897 | B2 * | 10/2021 | Tsukuda | F01D 11/005 |
| 2007/0196204 | A1 * | 8/2007 | Seitz | F04D 29/685 415/144 |
| 2008/0080972 | A1 * | 4/2008 | Bunker | F01D 5/225 415/174.5 |
| 2014/0072415 | A1 | 3/2014 | Zheng et al. | |
| 2015/0184750 | A1 * | 7/2015 | Kuwamura | F01D 5/225 277/355 |
| 2016/0047265 | A1 * | 2/2016 | Matsumoto | F01D 11/08 415/173.1 |
| 2020/0040752 | A1 * | 2/2020 | Tsukuda | F01D 11/005 |

FOREIGN PATENT DOCUMENTS

| | | |
|---|---|---|
| JP | 2014-55588 | 3/2014 |
| WO | 2014/162767 | 10/2014 |

* cited by examiner

STEAM TURBINE

CROSS-REFERENCE TO RELATED APPLICATIONS

This application claims the benefit of priority to Japanese Patent Application Number 2019-208744 filed on Nov. 19, 2019. The entire contents of the above-identified application are hereby incorporated by reference.

TECHNICAL FIELD

The disclosure relates to a steam turbine.

RELATED ART

In a general steam turbine, a fixed clearance is provided between a tip (shroud) of a rotor blade and an inner circumferential surface of a casing in order to allow a rotor to rotate smoothly. However, steam that flows through this clearance flows downstream without colliding with the rotor blade or a stator blade, and thus contributes nothing to rotational drive of the rotor. Because of this, distribution (leakage) of steam in the clearance needs to be reduced as much as possible. An example is known in which a plurality of seal fins protruding toward an outer circumferential surface of a rotor blade shroud is provided on the inner circumferential surface of the casing.

Here, in a space between the seal fins, a swirl flow is formed, which is referred to as a swirling flow that swirls about an axis in accordance with the rotation of the rotor. Specifically, the swirl flow swirls about the axis forward in a rotational direction from upstream to downstream. When radial displacement occurs in the rotor while the swirl flow develops, an imbalance occurs in circumferential pressure distribution in the space between the seal fins. This pressure distribution may generate a force (sealing excitation force) that excites oscillation of the rotation of the rotor. In order to reduce swirl flow, for example, a configuration provided with a swirl break disclosed in WO 2014/162767 A is practically used. Specifically, WO 2014/162767 A discloses a configuration in which a plate-like swirl break extending in an axial direction is disposed between the seal fins, and the swirl flow can be blocked by the swirl break.

SUMMARY

However, even when the swirl break is provided, a partial component of the swirl flow passes through a gap between the swirl break and the outer circumferential surface of the shroud and flows forward in the rotational direction. That is, in the configuration disclosed in WO 2014/162767 A, the swirl flow is still not sufficiently reduced and sealing excitation force may be generated.

The present disclosure has been made in order to solve the problems described above, and an object of the present disclosure is to provide a steam turbine in which a swirl flow is further reduced.

In order to solve the above problems, a steam turbine of the present disclosure includes a rotary shaft configured to rotate about an axis, a rotor blade including a rotor blade body extending radially outward from the rotary shaft, and a shroud provided on an end outside in a radial direction of the rotor blade body, a casing enclosing the rotor blade from outside in the radial direction and being formed with a cavity accommodating the shroud on an inner circumference of the casing, a plurality of seal fins protruding radially inward from an opposing surface that faces the shroud in the cavity and being formed with a clearance between an outer circumferential surface of the shroud, and a plurality of swirl breaks provided upstream of the plurality of seal fins located most upstream in a direction of the axis in the cavity, the plurality of swirl breaks being arranged at intervals in a circumferential direction, in which each of the plurality of swirl breaks is provided with a hole penetrating each of the plurality of swirl breaks.

A steam turbine of the present disclosure includes a rotary shaft configured to rotate about an axis, a rotor blade including a rotor blade body extending radially outward from the rotary shaft, and a shroud provided on an end outside in a radial direction of the rotor blade body, a casing enclosing the rotor blade from outside in the radial direction and being formed with a cavity accommodating the shroud on an inner circumference of the casing, a plurality of seal fins protruding radially inward from an opposing surface that faces the shroud in the cavity and being formed with a clearance between an outer circumferential surface of the shroud, and a plurality of swirl breaks provided upstream of the plurality of seal fins located most upstream in a direction of the axis in the cavity, the plurality of swirl breaks being arranged at intervals in a circumferential direction, in which each of the plurality of swirl breaks is provided with a cutout that retracts toward inside of each of the plurality of swirl breaks on an edge of each of the plurality of swirl breaks.

A steam turbine of the present disclosure includes a rotary shaft configured to rotate about an axis, a rotor blade including a rotor blade body extending radially outward from the rotary shaft, and a shroud provided on an end outside in a radial direction of the rotor blade body, a casing enclosing the rotor blade from outside in the radial direction and being formed with a cavity accommodating the shroud on an inner circumference of the casing, a plurality of seal fins protruding radially inward from an opposing surface that faces the shroud in the cavity and being formed with a clearance between an outer circumferential surface of the shroud, a plurality of swirl breaks provided upstream of the plurality of seal fins located most upstream in a direction of the axis in the cavity, plurality of swirl breaks being arranged at intervals in a circumferential direction, and a protrusion provided on an edge of each of the plurality of swirl breaks and protruding outward from each of the plurality of swirl breaks.

The present disclosure can provide a steam turbine in which swirl flow is further reduced.

BRIEF DESCRIPTION OF DRAWINGS

The disclosure will be described with reference to the accompanying drawings, wherein like numbers reference like elements.

DESCRIPTION OF EMBODIMENTS

First Embodiment

Configuration of Steam Turbine

Figure 1:
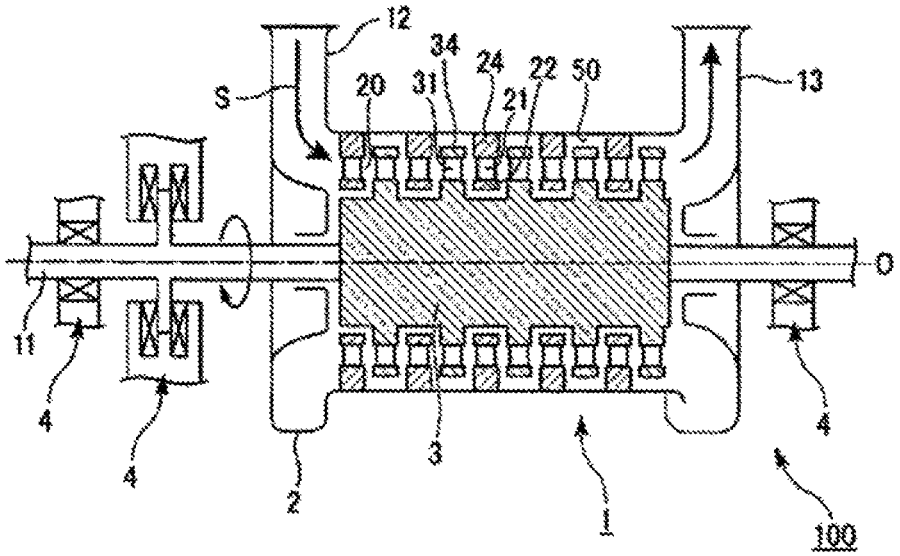
FIG. 1 is a schematic view illustrating a configuration of a steam turbine according to a first embodiment of the present disclosure.
Figure 2:
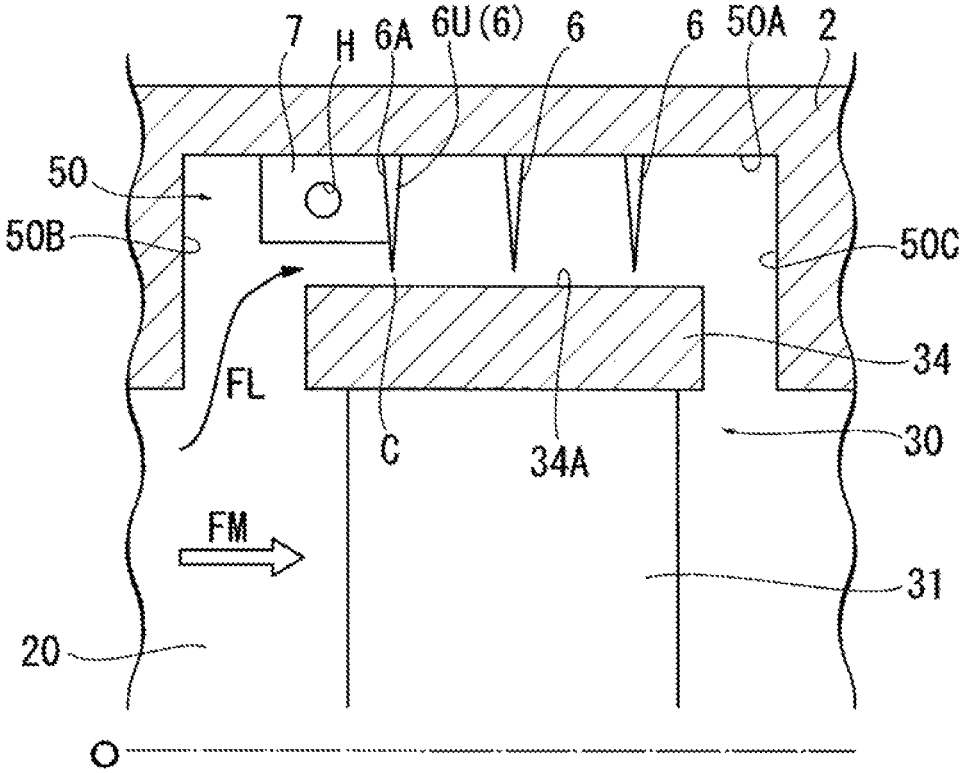
FIG. 2 is an expanded view of a main part of the steam turbine according to the first embodiment of the present disclosure.

Hereinafter, a steam turbine 1 according to a first embodiment of the present disclosure will be described with reference to FIGS. 1 to 3. As illustrated in FIG. 1 or 2, the steam turbine 1 includes a steam turbine rotor 3 extending in a direction of an axis O, a steam turbine casing 2 (casing) formed with a cavity 50 that covers the steam turbine rotor 3 from an outer circumference and that accommodates a part of the steam turbine rotor 3 (a rotor blade shroud 34 described below), seal fins 6 and a swirl break 7 provided inside the cavity 50, and a plurality of bearing devices 4 rotatably supporting the steam turbine rotor 3 about the axis O.

The steam turbine rotor 3 includes a columnar rotary shaft 11 extending along the axis O, and a plurality of rotor blades 30 arranged in a circumferential direction on an outer circumferential surface of the rotary shaft 11. The plurality of rotor blades 30 forms a single-stage rotor blade stage. A plurality of rotor blade stages is arranged in the direction of the axis O on the outer circumferential surface of the rotary shaft 11. As illustrated in FIG. 2, each of the rotor blades 30 includes a blade body 31 (rotor blade body) and the rotor blade shroud 34 (shroud). The blade body 31 protrudes outward in a radial direction from an outer circumferential surface of the steam turbine rotor 3. The blade body 31 has a blade-shaped section when viewed from the radial direction. The rotor blade shroud 34 is provided on a tip (radially outside end) of the blade body 31.

As illustrated in FIG. 1 again, the steam turbine casing 2 has a substantially cylindrical shape covering the steam turbine rotor 3 from the outer circumference. A steam supply pipe 12 that introduces steam S is provided on one side of the steam turbine casing 2 in the axis O direction. A steam discharge pipe 13 that discharges the steam S is provided on the other side of the steam turbine casing 2 in the axis O direction. In the following description, a side on which the steam supply pipe 12 is located when viewed from the steam discharge pipe 13 is referred to as upstream, and a side on which the steam discharge pipe 13 is located when viewed from the steam supply pipe 12 is referred to as downstream.

A plurality of stator blades 21 is provided along an inner circumferential surface of the steam turbine casing 2. The stator blades 21 are blade-shaped members connected to the inner circumferential surface of the steam turbine casing 2 via a stator blade seat 24. Furthermore, a stator blade shroud 22 is provided on a tip (radially inside end) of each of the stator blades 21. Similarly to the rotor blades 30, the plurality of stator blades 21 is arranged along the circumferential direction and the axis O direction on the inner circumferential surface of the stator blades 21. Each of the rotor blades 30 is disposed so as to enter a region between adjacent stator blades 21 of the plurality of stator blades 21.

A region where the stator blades 21 and the rotor blades 30 are arranged in the steam turbine casing 2 forms a main channel 20 through which the steam S as a working fluid flows. The cavity 50, which is recessed outward in the radial direction with respect to the axis O, is formed between the inner circumferential surface of the steam turbine casing 2 and the rotor blade shroud 34 over the entire circumferential direction. The cavity 50 accommodates the tip of each of the rotor blades 30 (rotor blade shroud 34).

Each of the bearing devices 4 includes a journal bearing that supports a load in the radial direction with respect to the axis O, and a thrust bearing that supports a load in the direction of the axis O. In the present embodiment, one journal bearing is provided on each end of the rotary shaft 11, and one thrust bearing is provided on only one end of the rotary shaft 11. Note that the arrangement and quantity of the bearing devices 4 can be appropriately changed in accordance with design and specification.

Next, configurations of the seal fins 6 and the swirl break 7 provided in the cavity 50 will be described in detail with reference to FIGS. 2 and 3. As illustrated in FIG. 2, the cavity 50 is recessed outward in the radial direction from the inner circumferential surface of the steam turbine casing 2. Of inner surfaces of the cavity 50, a surface facing an outer circumferential surface of the rotor blade shroud 34 (a shroud outer circumferential surface 34A) is an opposing surface 50A. Of the inner surfaces of the cavity 50, a surface located upstream is an upstream surface 50B, and a surface located downstream is a downstream surface 50C. The opposing surface 50A is orthogonal to the upstream surface 50B and the downstream surface 50C in a sectional view including the axis O. That is, the cavity 50 is recessed in a rectangular shape from the inner circumferential surface of the steam turbine casing 2.

A plurality (for example, three) of the seal fins 6 is provided on the opposing surface 50A at equal intervals in the direction of the axis O. The seal fins 6 protrude radially inward from the opposing surface 50A. A clearance C is formed between tips (radially inside ends) of the seal fins 6 and the shroud outer circumferential surface 34A. Each of the seal fins 6 has an annular shape centered on the axis O. Each of the seal fins 6 is formed such that a dimension in the direction of the axis O gradually decreases from outside to inside in the radial direction. Of the plurality of seal fins 6, the swirl break 7 is provided between the opposing surface 50A and a surface facing upstream (an upstream fin surface 6A) of the seal fin 6 located the most upstream (an upstream seal fin 6U).

The swirl break 7 is provided to reduce the swirl flow S (described below) flowing through the cavity 50. The swirl break 7 protrudes radially inward from the opposing surface 50A, and has a plate shape extending in a plane defined by the direction of the axis O and the radial direction. An edge of the swirl break 7 inward in the radial direction is located radially outward with respect to an edge of the seal fins 6 inward in the radial direction. Further, an interval extending in the direction of the axis O is formed between an upstream edge of the swirl break 7 and the upstream surface 50B of the cavity 50. Furthermore, the upstream edge of the swirl break 7 is located upstream of the upstream edge of the rotor blade shroud 34.

A plurality of the swirl breaks 7 is provided at intervals in the circumferential direction with respect to the axis O. As illustrated in FIG. 3, a space enclosed by a pair of the swirl breaks 7 adjacent in the circumferential direction and the opposing surface 50A is a unit space A.

One hole H penetrating through each of the swirl breaks 7 in a thickness direction is formed in each of the swirl breaks 7. An opening of the hole H is, for example, in a circular shape in the present embodiment. The hole H preferably has an opening area of 50% or less with respect to an area of each of the swirl breaks 7 when viewed from the circumferential direction.

Operational Effects

In order to operate the steam turbine 1, the steam S having a high temperature and high pressure is first introduced into the steam turbine casing 2 through the steam supply pipe 12 from an external device. The steam that has flowed into the steam turbine casing 2 flows through the main channel 20 in the steam turbine casing 2 in the direction of the axis O. On its way, the steam is guided by the stator blades 21 and collides with the rotor blades 30, thereby imparting a rotational force about the axis O to the steam turbine rotor 3. A rotational energy of the steam turbine rotor 3 is extracted from an axial end and is used to drive other devices including, for example, a generator.

Here, as illustrated in FIG. 2, some components of the steam (a main flow FM) flowing in the main channel 20 branch from the main flow FM and flow into the cavity 50 as a leakage flow FL. This leakage flow FL includes a component that swirls about the axis O. That is, as illustrated in FIG. 3, a swirl flow S that swirls in a rotational direction Dr of the steam turbine rotor 3 is formed in the cavity 50. When radial displacement occurs in the steam turbine rotor 3 while the swirl flow S develops, an imbalance occurs in circumferential pressure distribution in the space between the seal fins 6. This pressure distribution may generate a force (sealing excitation force) that excites oscillation of the rotation of the steam turbine rotor 3.

Therefore, in the present embodiment, the swirl break 7 is provided upstream of the upstream seal fin 6U. Furthermore, the hole H is formed in the swirl break 7. Thus, the partial component (flow component indicated by an arrow S1 in FIG. 3) of the swirl flow S that has flowed into the unit space A between the swirl breaks 7 is guided through the hole H forward in the rotational direction Dr. This flow component S1 that has passed through the hole H flows radially inward along the surface of the swirl break 7.

Meanwhile, a separate component S2 (separated flow) of the swirl flow S that has passed between the edge of the swirl break 7 inward in the radial direction and the outer circumferential surface of the rotor blade shroud 34 (shroud outer circumferential surface 34A) forms a vortex V in the unit space A formed between the swirl breaks 7. This vortex V develops so as to extend forward in the rotational direction Dr from the edge of the swirl break 7 inward in the radial direction. Further, when viewed from upstream, the vortex V swirls from the shroud outer circumferential surface 34A in a direction toward the swirl break 7 on a rear side in the rotational direction Dr through the swirl break 7 on a front side in the rotational direction Dr and the opposing surface 50A of the cavity 50. That is, on the surface of the swirl break 7 on the rear side in the rotational direction Dr, the vortex V flows radially inward similarly to the partial component S1 of the swirl flow S that has passed through the hole H.

These two streams interfere with each other and are drawn to each other. As a result, the vortex V is drawn toward the surface of the swirl break 7 on the rear side in the rotational direction Dr, resulting in a vortex V having a higher swirling force. The presence of this strong vortex V can further reduce the swirl flow S.

Figure 3:
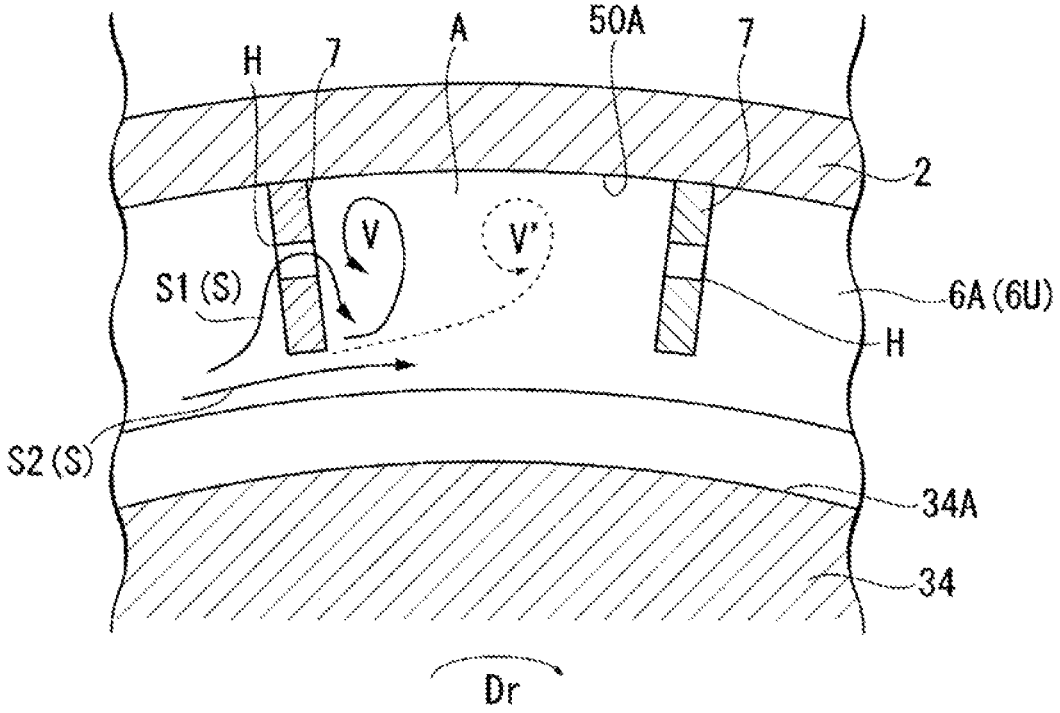
FIG. 3 is a diagram of a swirl break according to the first embodiment of the present disclosure as viewed from an axial direction.

On the other hand, when the hole H is not formed in the swirl break 7, a vortex V' is formed at a position spaced apart from the swirl break 7 as indicated by the dashed arrow in FIG. 3, and a swirling strength of the vortex V' is lower than that of the vortex V. As a result, an inhibitory effect on the swirl flow S may not be sufficiently obtained. However, the above configuration can reduce such a possibility and more efficiently inhibit the swirl flow S.

Second Embodiment

Figure 4:
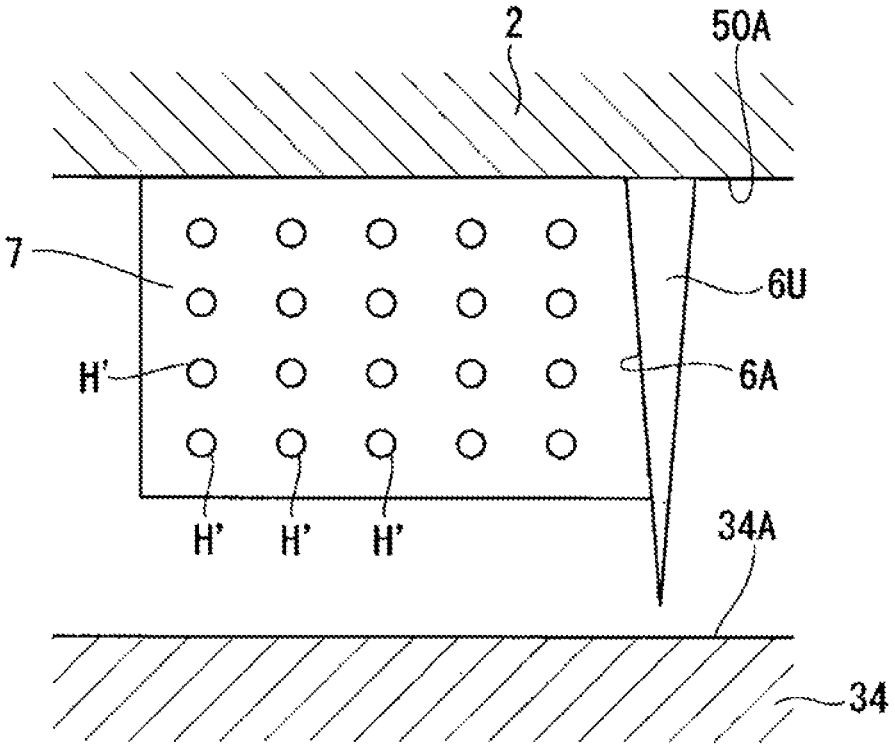
FIG. 4 is an enlarged view of a swirl break according to a second embodiment of the present disclosure.

Next, a second embodiment of the present disclosure will be described with reference to FIG. 4. The same components as those of the first embodiment are denoted by the same reference signs, and a detailed description thereof will be omitted. As illustrated in FIG. 4, the present embodiment has a configuration different from the first embodiment in that a plurality of holes H' is formed in the swirl break 7. When viewed from the circumferential direction, the plurality of holes H' is arranged at intervals so as to form a lattice shape.

In the above configuration, the plurality of holes H' is formed in the swirl break 7, and thus flow through the holes H' increases. As a result, the vortex V can be drawn more strongly toward the swirl break 7. This can further increase the swirling force of the vortex V and greatly reduce the swirl flow S.

Figure 5:
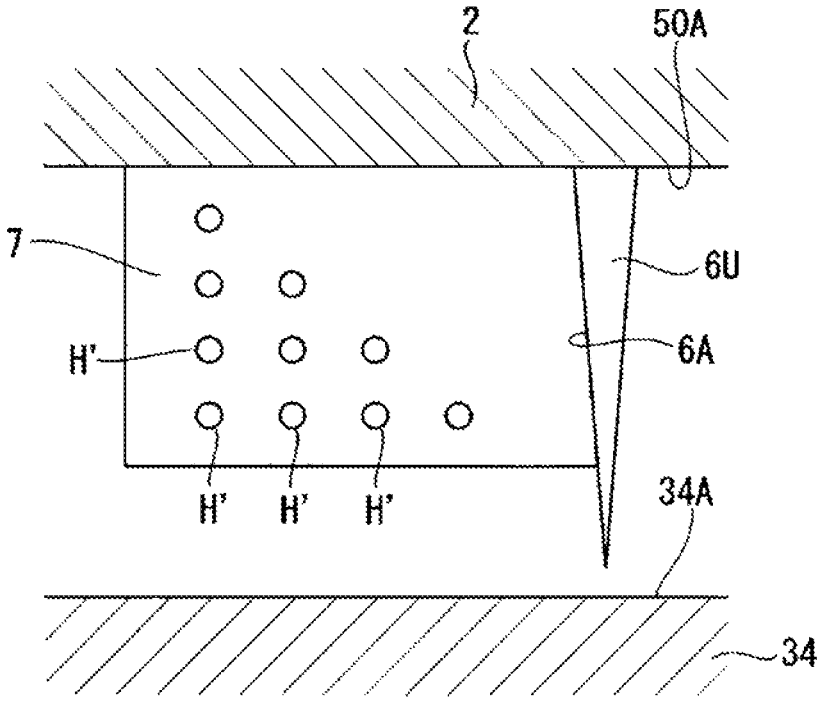
FIG. 5 is an enlarged view of a swirl break according to a modification of the second embodiment of the present disclosure.

Note that in the example of FIG. 4, a configuration has been described in which the plurality of holes H' is uniformly arranged across the entire area of the swirl break 7. However, as illustrated in FIG. 5 as a modification, a larger number of holes H' may be formed closer to a region on the rear side in the rotational direction Dr of the rotary shaft 11 in the swirl break 7.

Here, the flow component S2 (separate flow) passing between the edge of the swirl break 7 inward in the radial direction and the shroud outer circumferential surface 34A increases as the flow component S2 travels toward the region on the rear side of the rotational direction Dr in the swirl break 7. In the above configuration, a greater number of holes H' are formed closer to a region where more of the separate flow (flow component S2) occurs. This can more efficiently help develop the vortex V due to the holes H'. Further, compared to a case where the holes H' are formed across the entire area of the swirl break 7, manufacturing steps and costs can be reduced, and a decrease in strength of the swirl break 7 can be suppressed.

Third Embodiment

Figure 6:
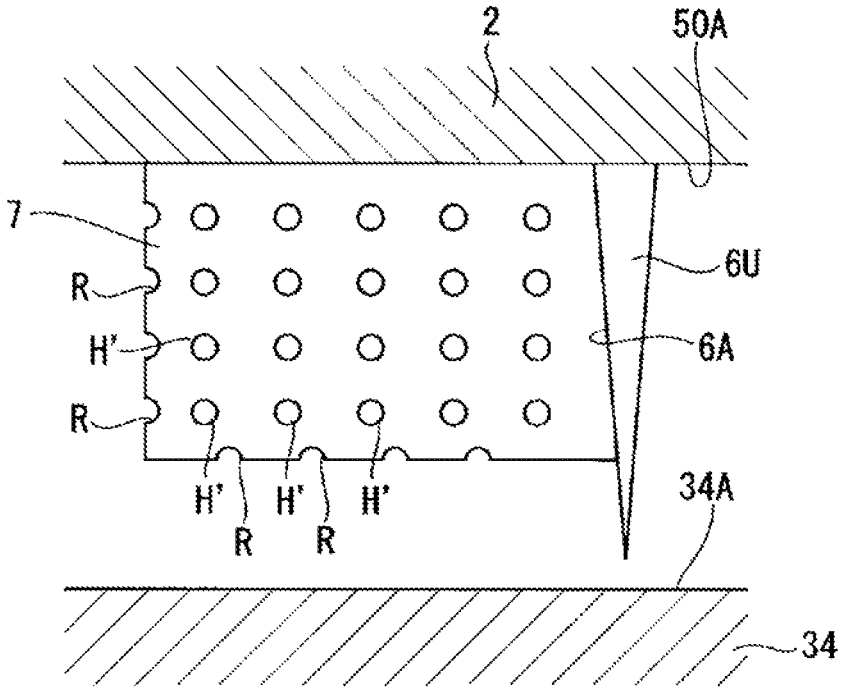
FIG. 6 is an enlarged view of a swirl break according to a third embodiment of the present disclosure.

Next, a third embodiment of the present disclosure will be described with reference to FIG. 6. The same components as those in the above embodiments are denoted by the same reference signs, and a detailed description thereof will be omitted. As illustrated in FIG. 6, in the present embodiment, a plurality of cutouts R is formed in each of the edges (edges extending in the direction of the axis O and edges extending in the radial direction) of the swirl breaks 7 described in the second embodiment. Each of the cutouts R is retracted from the edges of the swirl break 7 toward the inside of the swirl break 7. Each of the cutouts R has a semi-circular shape, for example. Note that the shape of the cutouts R may be rectangular or polygonal.

In the above configuration, the cutouts R, which are formed on the edges of the swirl break 7, can impart a turbulent flow component to the swirl flow S passing through the edges. Due to this disturbance of flow, the vortex V formed in the unit space A between the swirl breaks 7 is drawn toward the surface of the swirl break 7 on the rear side in the rotational direction Dr, resulting in a vortex V having a stronger swirling force. The presence of this strong vortex V can further reduce the swirl flow S.

Figure 7:
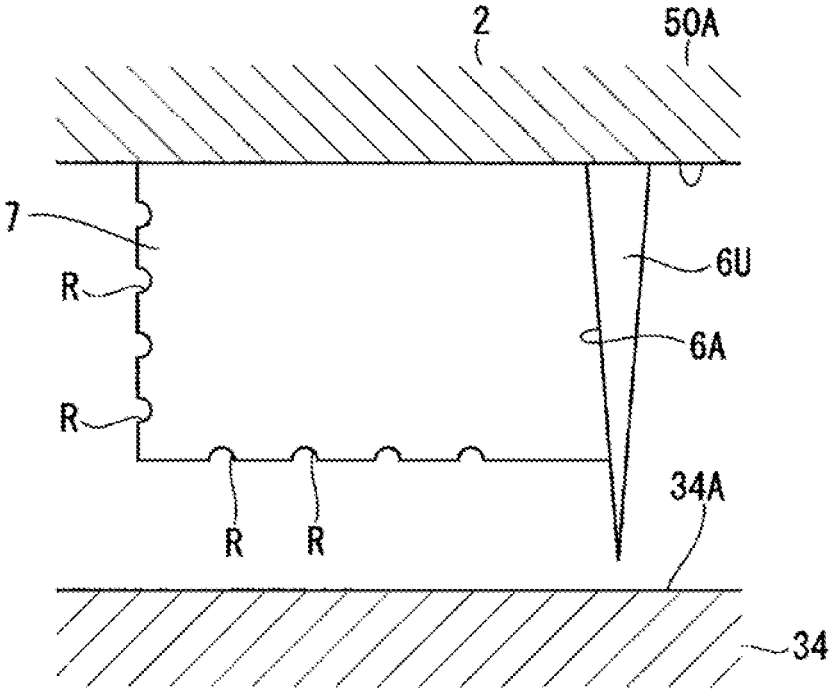
FIG. 7 is an enlarged view of a swirl break according to a modification of the third embodiment of the present disclosure.

Note that, as illustrated as a modification in FIG. 7, it is also possible to adopt a configuration in which only the cutouts R are formed without forming the holes H' in the swirl break 7. Such a configuration can also sufficiently reduce the swirl flow S.

Fourth Embodiment

Figure 8:
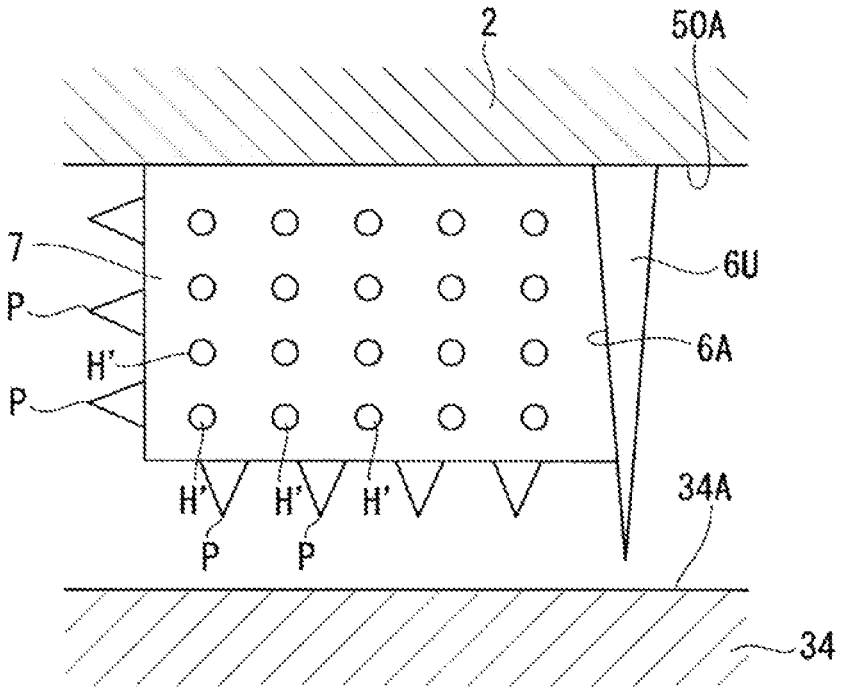
FIG. 8 is an enlarged view of a swirl break according to a fourth embodiment of the present disclosure.

Next, a fourth embodiment of the present disclosure will be described with reference to FIG. 8. The same components as those in the above embodiments are denoted by the same reference signs, and a detailed description thereof will be omitted. As illustrated in FIG. 8, in the present embodiment, a plurality of protrusions P is formed on the edges (edges extending in the direction of the axis O and edges extending in the radial direction) of the swirl breaks 7 described in the second embodiment. Each of the protrusions P protrudes from the edges of the swirl break 7 toward the outside of the swirl break 7. Each of the protrusions P forms a triangular shape, for example. Note that the shape of the protrusions P may be rectangular, polygonal, or semi-circular.

In the above configuration, the protrusions P, which are formed on the edges of the swirl break 7, can impart a turbulent flow component to the swirl flow S passing through the edges. Due to this disturbance of flow, the vortex V formed in the unit space A between the swirl breaks 7 is drawn toward the surface of the swirl break 7 on the rear side in the rotational direction Dr, resulting in a vortex V having a stronger swirling force. The presence of this strong vortex V can further reduce the swirl flow S.

Figure 9:
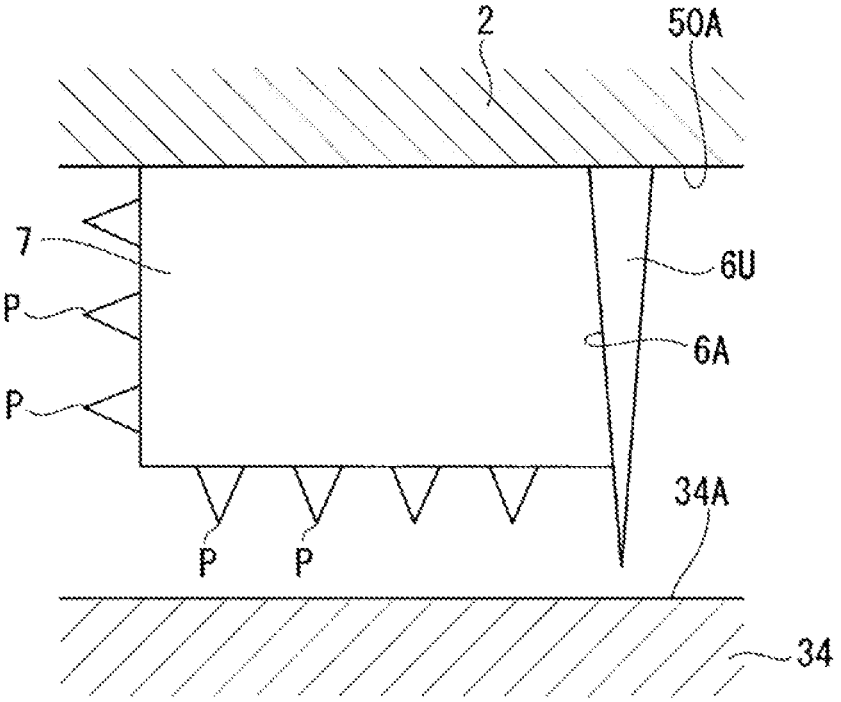
FIG. 9 is an enlarged view of a swirl break according to a modification of the fourth embodiment of the present disclosure.

Note that, as illustrated as a modification in FIG. 9, it is also possible to adopt a configuration in which only the protrusions P are formed without forming the holes H' in the swirl break 7. Such a configuration can also sufficiently reduce the swirl flow S.

Other Embodiments

Embodiments of the present disclosure have been described above in detail with reference to the drawings, but the specific configurations are not limited to these embodiments, and design changes and the like that do not depart from the scope of the present disclosure are also included.

Figure 10:
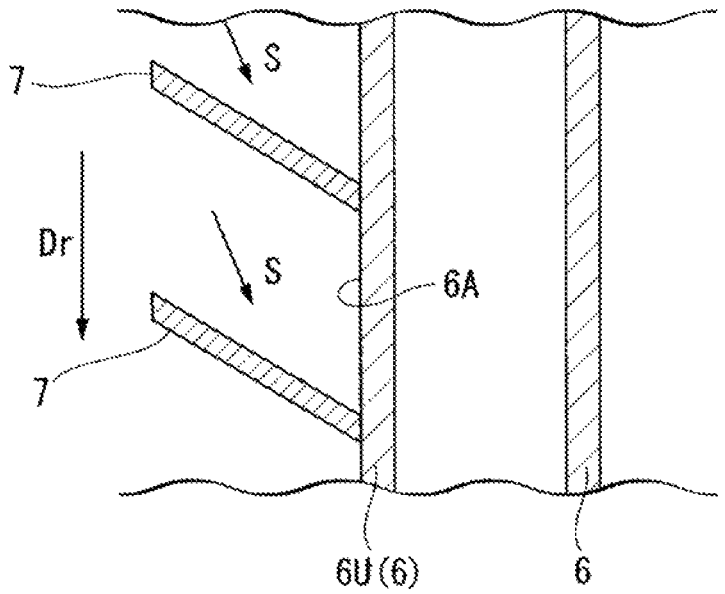
FIG. 10 is a view of a swirl break according to a modification common to the embodiments of the present disclosure, viewed from outside in a radial direction.

For example, in each of the above embodiments, an example has been described in which the swirl breaks 7 spread out in a plane defined by the axis O direction and the radial direction. However, as a modification common to each embodiment, the configuration shown in FIG. 10 can be adopted. In the example illustrated in FIG. 10, the swirl breaks 7 extend forward in the rotational direction Dr of the rotary shaft 11 from upstream to downstream. In this configuration, the swirl flow S can be more efficiently captured and reduced by the swirl breaks 7 extending forward in the rotational direction Dr from upstream to downstream.

Notes

The steam turbine according to each of the embodiments is construed, for example, in the following manner.

(1) A steam turbine 1 according to a first aspect includes a rotary shaft 11 configured to rotate about an axis O, a rotor blade 30 including a rotor blade body 31 extending radially outward from the rotary shaft 11, and a shroud 34 provided on an end outside in a radial direction of the rotor blade body 31, a casing 2 enclosing the rotor blade 30 from outside in the radial direction and being formed with a cavity 50 accommodating the shroud 34 on an inner circumference of the casing 2, a plurality of seal fins 6 protruding radially inward from an opposing surface 50A that faces the shroud 34 in the cavity 50 and being formed with a clearance C between an outer circumferential surface 34A of the shroud 34, and a plurality of swirl breaks 7 provided upstream of the seal fin 6U located most upstream in a direction of the axis O in the cavity 50, the plurality of swirl breaks 7 being arranged at intervals in a circumferential direction, in which each of the plurality of swirl breaks 7 is provided with a hole H penetrating each of the plurality of swirl breaks 7.

In the above configuration, the hole H is formed in each of the swirl breaks 7. Thus, the partial component S1 of the swirl flow S that has flowed into the space between the swirl breaks 7 is guided through the holes H forward in the rotational direction Dr. Subsequently, this partial component S1 flows inward in the radial direction along the surface of each of the swirl breaks 7.

Meanwhile, a separate component S2 (separated flow) of the swirl flow S that has passed between the edge of each of the swirl breaks 7 inward in the radial direction and the outer circumferential surface 34A of the shroud 34 forms a vortex V in the space A formed between the swirl breaks 7. This vortex V develops so as to extend forward in the rotational direction Dr from the edge of the swirl break 7 inward in the radial direction. Further, when viewed from upstream, the vortex V swirls from the outer circumferential surface 34A of the shroud 34 in a direction toward the swirl breaks 7 on a rear side in the rotational direction Dr through each of the swirl breaks 7 on a front side in the rotational direction Dr and the opposing surface 50A of the cavity 50. That is, on the surface of the swirl break 7 on the rear side in the rotational direction Dr, the vortex V flows radially inward similarly to the partial component S1 of the swirl flow S that has passed through the hole H.

These two streams interfere with each other and are drawn to each other. As a result, the vortex V is drawn toward the surfaces of the swirl breaks 7 on the rear side in the rotational direction Dr, resulting in a vortex having a higher swirling force. The presence of this strong vortex V can further reduce the swirl flow S.

(2) In the steam turbine 1 according to a second aspect, each of the plurality of swirl breaks 7 is provided with a plurality of the holes H' spaced apart from each other.

In the above configuration, the plurality of holes H' is formed in each of the swirl breaks 7, and thus the flow through the holes H' increases. As a result, the vortex V can be drawn more strongly toward the swirl breaks 7. Therefore, the swirling force of the vortex V can be further increased.

(3) In the steam turbine 1 according to a third aspect, a greater number of the holes H' are disposed closer to a region of each of the plurality of swirl breaks 7 on a rear side in a rotational direction Dr of the rotary shaft 11.

Here, the component S2 (separate flow) of the swirl flow S passing between the edge inside of each of the swirl breaks 7 in the radial direction and the outer circumferential surface 34A of the shroud 34 increases as the flow component S2 goes toward the region on the rear side of the rotational direction Dr in each of the swirl breaks 7. In the above configuration, a greater number of holes are formed closer to a region where more of the separate flow occurs. This can more efficiently help develop the vortex V due to the holes H'. Further, compared to a case where the holes H' are formed across the entire area of each swirl break 7, manufacturing steps and costs can be reduced, and a decrease in strength of the swirl break 7 can be suppressed.

(4) In the steam turbine 1 according to a fourth aspect, each of the plurality of swirl breaks 7 is provided with a cutout R that retracts inward of each of the plurality of swirl breaks 7 on an edge of each of the plurality of swirl breaks 7.

In the above configuration, the cutouts R, which are formed on the edges of the swirl breaks 7, can impart a turbulent flow component to the swirl flow S passing through the edges. Due to this disturbance of flow, the vortex V formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

(5) In the steam turbine 1 according to a fifth aspect, a plurality of the cutouts R is disposed on an edge of each of the plurality of swirl breaks 7 extending in a direction of the axis O and on an edge of each of the plurality of swirl breaks 7 extending in the radial direction with respect to the axis O.

The above configuration can impart a turbulent flow component to the swirl flow S passing through the edges of the swirl breaks 7. Thus, the vortex V formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

(6) The steam turbine 1 according to a sixth aspect is further includes a protrusion P provided on the edge of each of the plurality of swirl breaks 7 and protruding outward from each of the plurality of swirl breaks 7.

In the above configuration, the protrusions P, which are formed on the edges of the swirl breaks 7, can impart a turbulent flow component to the swirl flow S passing through the edges. Due to this disturbance of flow, the vortex V formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

(7) In the steam turbine 1 according to a seventh aspect, a plurality of the protrusions P is disposed on the edge of each of the plurality of swirl breaks 7 extending in a direction of the axis O and on the edge of each of the plurality of swirl breaks 7 extending in the radial direction with respect to the axis O.

The above configuration can impart a turbulent flow component to the swirl flow S passing through the edges of the swirl breaks 7. Thus, the vortex V formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

(8) In the steam turbine 1 according to an eighth aspect, the swirl breaks 7 extend forward in the rotational direction Dr of the rotary shaft 11 from upstream to downstream.

In the above configuration, the swirl flow S can be more efficiently captured and reduced by the swirl breaks 7 extending forward in the rotational direction Dr from upstream toward downstream.

(9) A steam turbine 1 according to a ninth aspect includes a rotary shaft 11 configured to rotate about an axis O, a rotor blade 30 including a rotor blade body 31 extending radially outward from the rotary shaft 11, and a shroud 34 provided on an end outside in a radial direction of the rotor blade body 31, a casing 2 enclosing the rotor blade 30 from outside in the radial direction and being formed with a cavity 50 accommodating the shroud 34 on an inner circumference of the casing 2, a plurality of seal fins 6 protruding radially inward from an opposing surface 50A that faces the shroud 34 in the cavity 50 and being formed with a clearance C between an outer circumferential surface 34A of the shroud 34, and a plurality of swirl breaks 7 provided upstream of the seal fin 6 located most upstream in a direction of the axis O in the cavity 50, the plurality of swirl breaks 7 arranged at intervals in a circumferential direction, in which each of the plurality of swirl breaks 7 is provided with a cutout R retracting toward inside of each of the plurality of swirl breaks 7 on an edge of each of the plurality of swirl breaks 7.

In the above configuration, the cutouts R, which are formed on the edges of the swirl breaks 7, can impart a turbulent flow component to the swirl flow S passing through the edges. Due to this disturbance of flow, the vortex V formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

(10) In the steam turbine 1 according to a tenth aspect, a plurality of the cutouts R is disposed on the edge of each of the swirl breaks 7 extending in a direction of the axis O and on the edge of each of the plurality of swirl breaks 7 extending in the radial direction with respect to the axis O.

The above configuration can impart a turbulent flow component to the swirl flow S passing through the edges of the swirl breaks 7. Thus, the vortex formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

(11) A steam turbine 1 according to an eleventh aspect includes a rotary shaft 11 configured to rotate about an axis O, a rotor blade 30 including a rotor blade body 31 extending radially outward from the rotary shaft 11, and a shroud 34 provided on an end outside in a radial direction of the rotor blade body 31, a casing 2 enclosing the rotor blade 30 from outside in the radial direction and being formed with a cavity 50 accommodating the shroud 34 on an inner circumference of the casing 2, a plurality of seal fins 6 protruding radially inward from an opposing surface 50A that faces the shroud 34 in the cavity 50 and being formed with a clearance C between an outer circumferential surface 34A of the shroud 34, a plurality of swirl breaks 7 provided upstream of the seal fin 6 located most upstream in a direction of the axis O in the cavity 50, the plurality of swirl breaks 7 being arranged at intervals in a circumferential direction, and a protrusion P provided on an edge of each of the plurality of swirl breaks 7 and protruding outward from each of the plurality of swirl breaks 7.

In the above configuration, the protrusions P, which are formed on the edges of the swirl breaks 7, can impart a turbulent flow component to the swirl flow S passing through the edges. Due to this disturbance of flow, the vortex V formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

(12) In the steam turbine 1 according to a twelfth aspect, a plurality of the protrusions P is disposed on the edge of each of the plurality of swirl breaks 7 extending in a direction of the axis O and on the edge of each of the swirl breaks 7 extending in the radial direction with respect to the axis O.

The above configuration can impart a turbulent flow component to the swirl flow S passing through the edges of the swirl breaks 7. Thus, the vortex V formed in the space A between the swirl breaks 7 is drawn toward the surfaces of the swirl breaks 7 on the rear side in the rotational direction Dr, resulting in a vortex having a stronger swirling force. The presence of this strong vortex V can further reduce the swirl flow S.

While preferred embodiments of the invention have been described as above, it is to be understood that variations and modifications will be apparent to those skilled in the art without departing from the scope and spirits of the invention. The scope of the invention, therefore, is to be determined solely by the following claims.

The invention claimed is:

1. A steam turbine comprising:

a rotary shaft configured to rotate about an axis;

a rotor blade including a rotor blade body extending radially outward from the rotary shaft, and a shroud on an end outside in a radial direction;

a casing enclosing the rotor blade from outside in the radial direction and including a cavity accommodating the shroud on an inner circumference of the casing;

a plurality of seal fins protruding radially inward from an opposing surface that faces the shroud in the cavity such that a clearance is between an outer circumferential surface of the shroud and the plurality of plurality of seal fins;

a plurality of swirl breaks upstream of the plurality of seal fins located furthest upstream in a direction of the axis in the cavity, the plurality of swirl breaks being arranged at intervals in a circumferential direction; and a protrusion on an edge of each of the plurality of swirl breaks, the protrusion protruding outward from each of the plurality of swirl breaks and having a triangular shape.

2. The steam turbine according to claim 1, wherein the protrusion is one of a plurality of protrusions on the edge of each of the plurality of swirl breaks extending in a direction of the axis and on the edge of each of the plurality of swirl breaks extending in the radial direction with respect to the axis.

* * * * *